United States Patent [19]

Fukuda et al.

[11] Patent Number: 4,913,747

[45] Date of Patent: Apr. 3, 1990

[54] METHOD OF AND APPARATUS FOR HEAT-TREATING RAILS

[75] Inventors: Keiji Fukuda; Takefumi Suzuki; Hideaki Kageyama; Yoshiaki Makino; Masanori Hisatsune; Eigo Matsubara; Mitiaki Ishii; Manabu Sato; Haruo Koyama, all of Kitakyushu, Japan

[73] Assignee: Nippon Steel Corporation, Tokyo, Japan

[21] Appl. No.: 308,216

[22] Filed: Feb. 9, 1989

Related U.S. Application Data

[63] Continuation of Ser. No. 73,333, Jul. 13, 1987, abandoned, which is a continuation of Ser. No. 806,996, Dec. 9, 1985, abandoned.

[30] Foreign Application Priority Data

| | | | |
|---|---|---|---|
| Dec. 24, 1984 | [JP] | Japan | 59-272389 |
| Jun. 5, 1985 | [JP] | Japan | 60-120576 |
| Jul. 11, 1985 | [JP] | Japan | 60-151305 |

[51] Int. Cl.[4] ..... C21D 9/04

[52] U.S. Cl. ..... 148/128; 148/143; 148/145

[58] Field of Search ..... 148/143, 145, 146, 147, 148/148, 128

[56] References Cited

U.S. PATENT DOCUMENTS

| | | | |
|---|---|---|---|
| 1,516,407 | 11/1924 | Sandberg . | |
| 4,486,248 | 12/1984 | Ackert et al. | 148/145 |

FOREIGN PATENT DOCUMENTS

| | | | |
|---|---|---|---|
| 109171 | 12/1939 | Australia . | |
| 21838 | 5/1972 | Australia . | |
| 896346 | 3/1983 | Belgium . | |
| 899617 | 5/1984 | Belgium . | |
| 609575 | 11/1960 | Canada | 266/134 |
| 1024422 | 1/1978 | Canada . | |
| 98492 | 1/1984 | European Pat. Off. . | |
| 2136851 | 12/1972 | France . | |
| 110621 | 7/1982 | Japan | 148/143 |
| 23818 | 2/1984 | Japan | 148/146 |
| 515251 | 11/1939 | United Kingdom . | |
| 978312 | 12/1964 | United Kingdom | 266/134 |

*Primary Examiner*—S. Kastler

*Attorney, Agent, or Firm*—Pollock, Vande Sande & Priddy

[57] ABSTRACT

A method of heat-treating a rail for obtaining a variety of strength levels from medium value to high value. The method has the steps of: preparing a steel rail maintained at a high temperature region not lower than the austenite field, and disposing a nozzle means around the head of the rail such that the nozzle means can direct a gaseous cooling medium toward the head of the rail; determining the distance between the nozzle means and the head of the rail in accordance with both the hardness level to be attained in the head of the rail and the carbon equivalent of the steel constituting the rail; moving the nozzle means such that the distance is attained between the nozzle means and the head of the rail; and directing the gaseous cooling medium towards the head at a predetermined flow rate and for a predetermined time so as to cool the head of the rail thereby attaining the desired hardness level in the head of the rail.

4 Claims, 15 Drawing Sheets

H = 50mm
Q = 41Nm³/min
P = 1500mmAq
F = 31.8
θi = 800°C
τc = 140S

H = 20mm
Q = 41Nm³/min
P = 1500mmAq
F = 79.4
θi = 800°C
τc = 140S

METHOD OF AND APPARATUS FOR HEAT-TREATING RAILS

This is a continuation of Ser. No. 073,333, filed 7/13/87, which is a continuation of Ser. No. 806,996, filed 12/9/85, both now abandoned.

BACKGROUND OF THE INVENTION

The present invention relates to a heat-treating method and apparatus which can produce rails of a variety of strength levels by cooling the rails from a temperature range in austenite range after hot rolling or after a heating for the purpose of the heat treatment.

The current trend for heavier axle load and higher speed in railroad transportation has caused a tendency of rapid wear and fatigue of the rail heads, which in turn has given rise to the demands for rails having higher anti-wear and anti-damage properties, and for rails of various levels of strength from medium level strength (Hv>320) to high level strength (Hv>360).

Such a demand has been met, as confirmed through studies, by steel rails having fine pearlite structure. It is well known that this type of rails exhibit superior anti-wear and anti-damage properties.

An alloy steel rail as a prior art is disclosed in Japanese Unexamined Patent Publication No. 140316/1975. This rail is made of an alloy steel which is obtained by adding elements such as Si, Mn, Ni, Cr, Mo and Ti to a carbon steel, and is used in an as-rolled state. Japanese Examined patent Publication No. 23885/1980 discloses another prior art rail of a kind described below. This rail does not contain any alloy elements but the head portion of this rail is re-heated to a high temperature and is cooled from a predetermined temperature region with a control of the cooling rate throughout a certain temperature range.

The known rails, however, suffer from the following disadvantages.

Namely, the rail of the first mentioned type with its composition controlled by addition of alloy elements, intended for use in an as-rolled state, necessitates a large amount of alloy elements. These elements are generally expensive so that the cost of production of the rail is raised undesirably.

The rail of the second-mentioned type is produced typically by directing a cooling medium such as water and gas to the head of the rail material which has been heated to a high temperature, thereby forcibly cooling the rail head from the high temperature. This method is effective only when rails of a given strength are to be produced, and is not suited to the case where rails of a variety of strength levels are to be obtained. Although, in the production of this type of level, contents of carbon and other alloy elements added to the material fluctuate in the step of steel making which carbon and alloy elements substantially determine the level of the strength of the rails, it has been impossible to compensate for the fluctuation with the result that rails of desired strength level can not be obtained in the prior art.

SUMMARY OF THE INVENTION

Accordingly, an object of the invention is to provide a heat-treatment method for rails which is suitable for production of rails having a variety of strength levels from medium value to high value while possessing required properties such as anti-wear and anti-damage properties.

Another object of the invention is to provide a heat-treatment method for rails which is suitable for the production of rails having a variety of strength levels and which can make substantially uniform the values of properties such as anti-wear and anti-damage properties over the entire cross-section of the rail head.

Still another object of the invention is to provide apparatus for carrying out the method of the invention, more particularly an energy-saving heat-treatment apparatus for hot-rolled rails, having a cooling zone of a reduced length and, hence, requiring only a small installation space.

To these ends, according to an aspect of the invention, there is provided a method of heat-treating a rail for obtaining a variety of rail hardness levels from medium value to high value, the method comprising the steps of: preparing a steel rail maintained at a high temperature region not lower than the austenite field, and disposing a nozzle means around the head of the rail such that the nozzle means can direct a gaseous cooling medium towards the head of the rail; determining the distance between the nozzle means and the head of the rail in accordance with both the hardness level to be attained in the head of the rail and the carbon equivalent of the steel constituting the rail; moving the nozzle means such that the distance is attained between the nozzle means and the head of the rail; and directing the gaseous cooling medium towards the head at a predetermined flow rate and for a predetermined time so as to cool the head of the rail thereby attaining the desired hardness level in the head of the rail.

The carbon equivalent Ceq is given by the following formula:

$$(C+Mn/6+Si/24+Ni/40+Cr/5+Mo/4+V/14)$$

The rail treated by the method of the invention is made of a steel having a stable pearlite structure which steel consists essentially, by weight, of 0.55–0.85% C, 0.20–1.20% Si, 0.50–1.50% Mn and the balance Fe and incidental impurities. Chromium of 0.20–0.80 wt% may be added to the composition. Further, at least one kind selected from the group consisting of Nb, V, Ti, Mo, Cu and Ni may be added to the composition.

In a preferred form of the invented method, the cooling is effected in a controlled manner by means of a three-directional nozzle which is capable of directing a gaseous cooling medium (air, $N_2$ and etc.) independently in three directions, i.e., towards the top surface and both side surfaces of the rail head at constant rates. The gaseous cooling medium used in the cooling is exhausted from both gauge corners and both roots of the rail head. With this method, it is possible to attain a uniform hardness distribution over the entire portion of the rail head including the top surface, gauge corners, side surfaces and the lower jaw surfaces, while preventing excessive hardening or generation of undesirable structure such as bainite in the gauge corners which are apt to be overcooled.

According to another aspect of the invention, there is provided a heat-treatment apparatus for carrying out the heat-treating method for obtaining rails of a variety of rail hardness levels from medium value to high value, the apparatus comprising:

conveyor means for conveying said rail;

a rail head cooling means having a plurality of nozzles arranged around the head of said rail and adapted for directing a gaseous cooling medium towards the head of said rail; and a rail bottom cooling means disposed under the conveyor means and adapted to direct said gaseous cooling medium towards the bottom surface of the rail;

wherein the rail head cooling means is movable for allowing the distance between said nozzles and the head of the rail.

DESCRIPTION OF THE PREFERRED EMBODIMENTS

Figure 1:
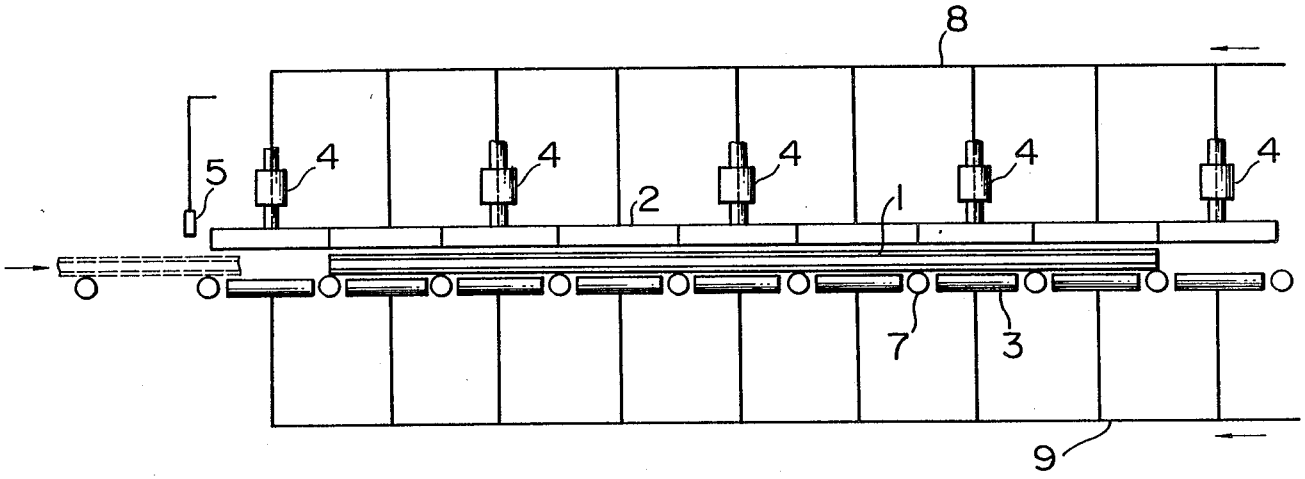
FIG. 1 is a side elevational view of a first embodiment of the cooling apparatus suitable for use in carrying out the first embodiment of the heat-treatment method in accordance with the invention.
Figure 2:
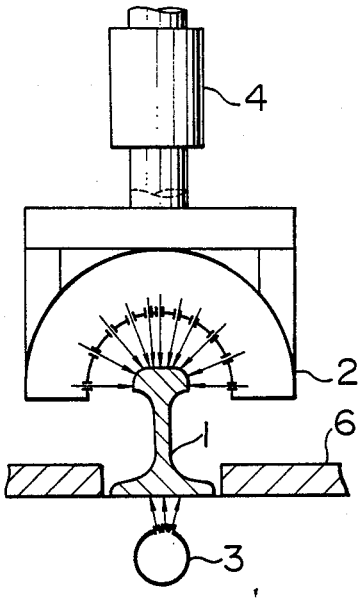
FIG. 2 is an enlarged sectional view of a portion of the cooling apparatus shown in FIG. 1.

FIGS. 1 and 2 schematically show an example of a first apparatus which is suitable for use in carrying out a first embodiment of the heat-treatment method in accordance with the invention. Referring first to FIG. 1, a rail 1 has been hot-rolled or heated for the purpose of heat-treatment, and is held at a temperature region not less than $Ar_3$ temperature. The heating to the temperature not less than the $Ar_3$ temperature is essential for obtaining, through an accelerated cooling, a fine pearlite structure which exhibits superior anti-wear and anti-damage properties. An upper nozzle header of a type semi-circularly surrounding the head of rail is extended in the direction of movement of the hot rail 1, i.e., in the longitudinal direction of the same. The header 2 has a nozzle which is adapted to direct a gaseous cooling medium such as air or $N_2$ gas onto the top surface and both side surfaces of the head of the hot rail 1. A lifting device 4 is provided for lifting and lowering the header 2 as desired. A thermometer 5 disposed at the inlet side of the cooling apparatus is adapted to measure the temperature $\theta_s$ of the top surface of the head of the hot rail 1. As will be seen from FIG. 2, the nozzles of the upper nozzle header 2 are arranged on a common arc so that they direct the cooling medium towards the center of the rail head, thus ensuring uniform cooling of the rail head surface and, hence, uniform strength distribution. A reference numeral 3 designates a lower nozzle header which is provided for movement in the direction of movement of the hot rail 1, i.e., in the longitudinal direction of the same, as is the case of the upper nozzle header, and is adapted to direct a gaseous cooling medium towards the center of the bottom surface of the hot rail 1. The lower nozzle header is intended for functioning as means for controlling the shape of the rail 1.

A description will be made hereinafter as to the first embodiment of the heat-treatment method of the invention, as well as the operation of the first cooling apparatus. It is assumed here that air is used as the gaseous cooling medium.

As stated before, the hot rail 1 is maintained at a temperature region not less than the $Ar_3$ temperature, as it has just been hot-rolled or heated intentionally for the purpose of the heat treatment. Before commencing the heat treatment, the carbon equivalent Ceq of the rail material has been determined by elementary analysis, whereas various conditions such as the hardness Hv to be obtained, flow rate Q of air used in the cooling and the upper header pressure P are given. When the nozzle header shown in FIG. 2 is used, the distance H between the upper nozzle header 2 and the top surface of the rail head is determined in accordance with the following formula (1):

$$Hv = 10^n + (200 \cdot Ceq - 190) \quad (1)$$

$$n = 2.4993 + 0.039887 \log F - 0.0051918 \log F^2$$

where,

Hv: hardness to be obtained through heat treatment regarding the depth down to 10 mm from the rail head surface (corresponds to strength) [Vicker's hardness 10 Kg]

Ceq: carbon equivalent

F: degree of cooling $F = Q.\sqrt{P}/H$

Q: flow rate of gaseous cooling medium applied to unit length of rail [$m^3$/m.min]

P: nozzle header pressure [mmAq, nozzle resistance coefficient f =0.85]

H: distance between nozzle header and rail head (mm)

n: coefficient determined by the type of nozzle

The cooling apparatus shown in FIG. 1 is set up such that the distance H determined as above is maintained between the upper nozzle header 2 and the rail head, and the rail 1 in the upright posture is fed in the longitudinal direction thereof.

The surface temperature $\theta_s$ of the top surface of the hot rail 1 is measured by the thermometer 5 provided at the inlet side of the cooling apparatus, and the cooling time $T_{AC}$ is computed by using the thus measured temperature $\theta_s$ in accordance with the following formula (2).

$$T_{AC} \geqq 0.336\ \theta_s - 150\ \text{(sec)} \qquad (2)$$

The rail 1 is moved through the cooling apparatus continuously or, as desired, intermittently or reciprocatingly, in accordance with the thus determined cooling time $T_{AC}$, so as to be cooled continuously.

By effecting the control in accordance with the conditions given by the formula (1), it is possible to obtain heat-treated rails of desired levels of strength and having superior anti-wear and anti-damage properties while compensating the fluctuation of amounts of alloying elements. Namely, in one hand, there is a demand for compensation for variation of strength due to the fluctuation of the amount of the alloy elements encountered in the steel making process, while on the other hand there is a demand for realizing means capable of obtaining a desired strength level of the rails in a wide variety range from 320 to 400 in terms of Hv (Vicker's hardness) with a single cooling apparatus. The present inventors have found that both these demands are met when the heat treatment is controlled by using the conditions of the carbon equivalent Ceq and the distance H. Thus, the heat-treatment method of the invention in accordance with the formula makes it possible to eliminate any unfavourable effect of the fluctuation of the alloy element contents, while affording a wide range of strength level control and an efficient composition design. This method is effective particularly in the control of the cooling of the hot-rolled rail from the temperature region not lower than the $Ar_3$ temperature.

Figure 3:
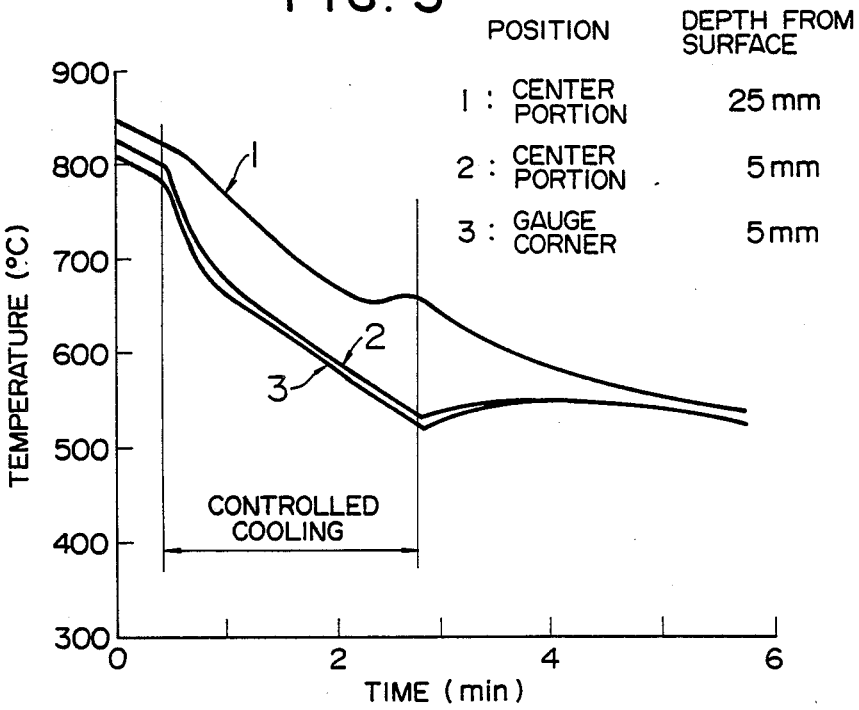
FIG. 3 is a graph showing a cooling curve indicating the cooling rate of a rail head cooled in accordance with an embodiment of the method of the invention.

On the other hand, the formula (2) mentioned before determines the cooling time. The heat treatment in accordance with the invention may be conducted with measurement of rail temperature. The measurement is conducted, for instance, at points as shown in FIG. 3. Namely, at a point which is 5 mm below the rail head top surface, a point which is 25 mm below the same and a points which are 5 mm under the gauge corners. The measuring point which is 25 mm below the head top surface is located substantially at the center of the rail head. If the cooling is conducted such that the temperature at this point is lowered to a level near the peak temperature presented by the reheating caused due to the heat of pearlite transformation, the pearlite transformation is substantially completed almost over the entire area of the head cross-section, so that the aimed strength level is stably obtained even when the cooling is ceased. Thus, the cooling time $T_{AC}$ can be determined from the measured temperature $\theta_s$ along the cooling curve, thus allowing a stable operation of the cooling apparatus.

A description will be made hereinunder as to the second embodiment of the heat-treatment method is accordance with the invention, as well as a second cooling apparatus suitable for use in carrying out this method.

In the first embodiment of the heat-treatment method of the invention, the application of the cooling medium onto the rail head such as a gas is conducted by means of the nozzle header which continuously surrounds the central top surface of the rail head and both side surfaces of the rail head as shown in FIGS. *6a* or *6b*. When this type of nozzle header is used, the gaseous cooling medium used in the cooling of the nozzle header is exhausted downwardly along both side surfaces of the rail head. In consequence, the cooling effect is progressively weakened towards the lower side of both side surfaces of the rail head, partly because the temperature of the cooling medium is gradually raised and partly because the impact of collision by the flow of the medium impinging upon these side surfaces is lessened due to the presence of the downward flow of the medium along these surfaces. In addition, the lower surfaces of the jaw portions cannot be cooled effectively. In consequence, the hardness distribution becomes non-uniform over the cross-section of the rail head. Namely, even though the desired hardness is obtained in the region near the top surface of the rail head, the regions near the side surfaces of the head and the lower surfaces of the jaw portions exhibit insufficient hardness. In addition, the hardness is unstable in the regions around the gauge corners due to, for example, generation of bainite structure as a result of overcooling.

These shortcomings are obviated by the second embodiment of the invention as will be understood from the following description.

Figure 9:
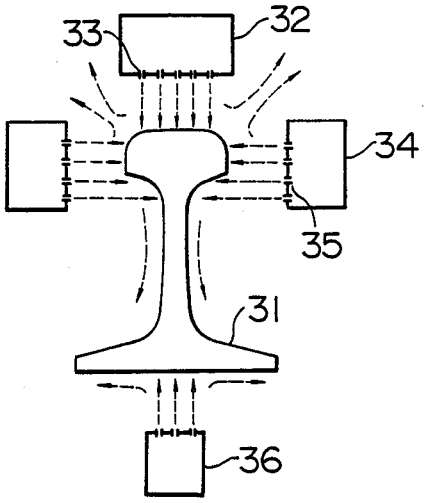
FIG. 9 shows an example of a nozzle header incorporated in cooling apparatus suitable for use in carrying out a second embodiment of the heat-treatment method in accordance with the invention.

FIG. 9 shows an example of arrangement of nozzle headers suitable for use in carrying out the second embodiment of the heat-treatment method of the invention. Referring to FIG. 9, a hot rail 31 is in a temperature region not less than the $Ar_3$ temperature, as it has just been hot-rolled or heated intentionally for the purpose of heat-treatment. The heating to the region not less than the $Ar_3$ temperature is essential for obtaining a fine pearlite structure which provides superior anti-wear and anti-damage properties after accelerated cooling. In this embodiment, the cooling apparatus employs three independent nozzle headers for the purpose of cooling the head portion of the rail: namely, a single header 32 for cooling the top surface of the rail head (referred to simply as "upper header", hereinunder) and a pair of headers 34 which are intended for cooling both side surfaces of the head and the lower surfaces of the jaw portions (referred to as "side headers", hereinunder). These headers 32, 34, 34 are disposed independently of each other and extend in the longitudinal direction of the rail. The upper header has nozzles 33 adapted to direct a gaseous cooling medium such as air or $N_2$ gas towards the top surface of the rail head, while the side headers 3, 34 have nozzles which are adapted to direct the cooling medium towards the side surfaces of the head and the lower surfaces of the jaw portions. In operation, the distances between the nozzles 33 and the rail head is determined in accordance with the level of the strength to be attained, as in the case of the first embodiment. The cooling medium after cooling the top surface of the head and the upper parts of the side surfaces of the head is exhausted through gaps around the gauge corners, while the cooling medium after cooling the lower parts of the side surfaces of the head and the lower surfaces of the jaw portions is discharged past the root portion of the rail head. In consequence, the cooling degree on the gauge corners are comparatively lessened so that the overcooling tendency of the gauge corners is prevented advantageously. In addition, the cooling effect is uniformalized over the entire portion of the surface regions of the rail head, thus ensuring a uniform strength distribution in the rail head portion.

A reference numeral 36 designates a nozzle header for cooling the bottom surface of the rail (referred to as "lower nozzle header", hereinunder). The lower nozzle header 36 is extended along the length of the upper and side nozzle headers 32, 34, and is adapted to direct the gaseous cooling medium towards the bottom surface of the rail 1. As shown in FIG. 9, the lower header 36 faces the bottom surface of the rail 1, and performs a function of controlling the shape of the rail 1.

According to this embodiment shown in FIG. 9, the gaps through which the cooling medium after the cooling is exhausted are formed along the gauge corners of the rail head, so that the gauge corners are not directly cooled by the fresh cooling medium but by the cooling medium which has cooled other portions of the rail head. In consequence, the cooling power on the gauge corners is lessened as compared with those on the top surface and both side surfaces of the rail head so that the edge corners are cooled substantially at the same rate as the top surface and both side surfaces of the rail head. In consequence, the undesirable generation of bainite structure in the gauge corner regions is avoided. In addition, since about half of the cooling medium directed to the side surfaces of the head is discharged through the gaps which extend along the gauge corners, it becomes possible to directly apply the cooling medium to the lower surfaces of the jaw portions, thus afforing a further uniformalization of the hardness over the surface regions of the rail head.

An explanation will be made hereinunder as to an embodiment in which the control of the shape of the rail is effectively controlled by the application of a gaseous cooling medium from the nozzles of the lower nozzle header onto the bottom surface of the rail.

Figure 12A:
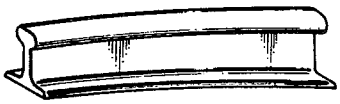
FIGS. 12*a* and 12*b* are illustrations of bending of rails during cooling.
Figure 12B:
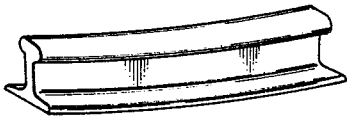

The heat-treatment method of the invention which relies upon the forcible local cooling of a rail by the application of a gaseous medium onto the rail head tends to cause a large temperature gradient in the rail, particularly when the cooling is conducted only at the head portion of the rail, resulting in a positive bend in which the rail head is convexed upwardly as shown in FIG. 12*a* or negative bend in which the rail head is concaved downwardly as shown in FIG. 12*b*. This bending defect can be eliminated by applying the gaseous cooling medium to the bottom surface of the rail under a controlled condition, during the cooling of the rail head by the gaseous cooling medium.

Figure 13:
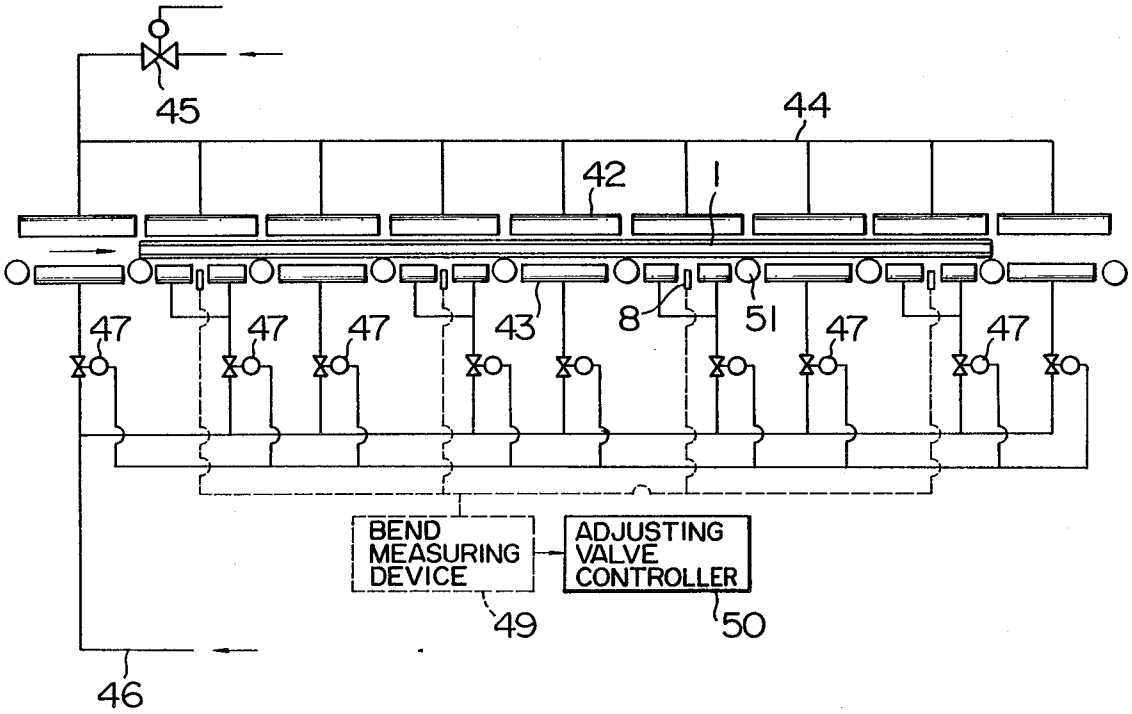
FIG. 13 is a side elevational view of a cooling apparatus employed in connection with the method for preventing bending of rail.
Figure 14:
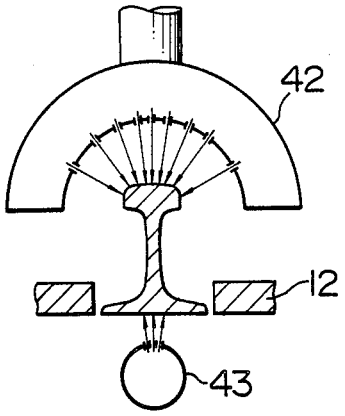
FIG. 14 is an enlarged sectional view of a portion of the cooling apparatus employed in connection with the apparatus in FIG. 13.

FIGS. 13 and 14 show an example of the arrangement of the apparatus for preventing the bend of the rail. As shown in FIG. 14, this apparatus has an upper nozzle header 42 which is similar to the nozzle header employed in the first embodiment. Thus, the upper nozzle header 42 has nozzles which are arranged on a common arc so as to direct the cooling medium to the head of the rail. The apparatus also has a lower nozzle header 43 which is extended in the direction of the movement of the hot rail 1, as is the case of the upper nozzle header 42, so as to direct the cooling medium to the lower surface of the rail bottom portion, i.e., to the rail bottom surface. The nozzles of the lower nozzle header 43 may be arranged concentrically in the vicinity of the rail 1 so that the cooling medium is directed to the central thick-walled portion of the rail bottom or may be arranged such that the cooling medium is distributed over the entire area of the rail foot. Preferably, the ratio of the total nozzle area of the lower nozzle header 43 to that of the upper nozzle header 42 is selected to range between ½ and 1/5.

The apparatus further has a head cooling medium supply line 44 which is connected at its inlet side to a source (not shown) of the colling medium and at its outlet side to the upper nozzle headers 42 through a medium flow-rate adjusting valve 45. Similarly, a rail bottom cooling medium supply line has an inlet end connected to a source (not shown) of the cooling medium and an outlet end which is connected to the lower nozzle headers 43 through medium flow-rate adjusting valves 47. A bend measuring device 49 is connected to bend (displacement) detectors 48 which are disposed between adjacent lower nozzle headers 43. An adjusting valve controller 50 is adapted to control the opening degrees of the cooling medium flow-rate adjusting valves 46 in accordance with the detected amounts of bend. Thus, the medium flow-rate adjusting valves 46 are operable independently so as to adjust the flow rates of the cooling medium in accordance with the amounts of bend of the hot rail 1. The control of the cooling medium flow-rate adjusting valves 46 may be conducted manually by an operator who can visually check the amounts of bend on the basis of experience. A reference numeral 51 designates conveyor rollers.

During the cooling of the rail head by the application of the gaseous cooling medium, the rates of supply of the gaseous cooling medium from the lower nozzle headers 43 are adjusted in accordance with the result of measurement by the bend measuring device 49. More specifically, the measurement of bend (displacement) is commenced without delay after the feed of the rail 1 into the cooling apparatus. The rate of temperature drop is greater at the bottom portion of the rail than at the head portion of the same, immediately after the feed of the rail into the cooling apparatus. In consequence, the rail shows a large temperature gradient between the head and the bottom and is deflected such that the head is convexed upwardly, i.e., to exhibit the tendency of positive bend as shown in FIG. 12*a*. When the positive bend of the rail is detected, the flow rate of the cooling medium from the lower nozzle header is decreased without delay so as to reduce the cooling degree on the bottom of the rail. In consequence, the temperature difference between the head and the bottom is diminished to reduce the bend.

As the rail temperature is lowered, the temperature of the rail bottom comes down to the transformation temperature range. In this state, the rail tends to exhibit the negative bend as shown in FIG. 12*b*, due to the transformation elongation of the rail bottom. When the negative bend is detected, the rate of supply of air to the lower nozzle header 43 is increased to enhance the cooling rate of the rail bottom. As a result, the amounts of elongation of the rail head and the rail bottom are substantially equalized, so that the bend is minimized. As the temperature is further lowered, the transformation in the rail bottom is completed and the rail head temperature comes down to the transformation temperature range. As a result, the rail again exhibits the tendency of positive bend due to transformation elongation of the rail head. Upon detection of this tendency, the rate of supply of the cooling medium from the lower nozzle head is decreased so as to minimize the bend.

In another method of effecting the control of the rail shape through the cooling of the rail bottom surface, a constraining device is provided over the entire length of the rail so as to fix and constrain the rail against bending. In operation, throughout the period of cooling of the rail head, the cooling medium is applied to the bottom surface of the constrained rail at a constant flow-rate which is selected so as to minimize the vertical bend after the completion of the heat treatment. This method also permits the shape of the rail to be controlled.

Another embodiment of the heat-treatment apparatus for carrying out the heat-treatment method of the invention will be described hereinunder.

Figure 18:
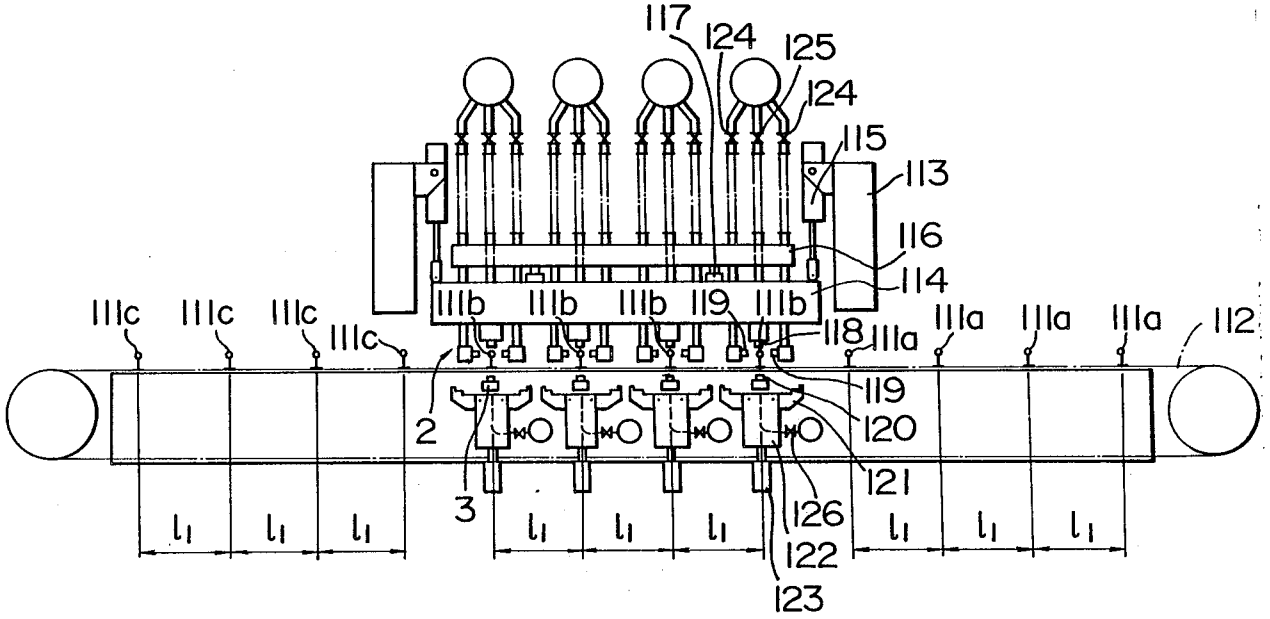
FIG. 18 is a front elevational view of an embodiment of a heat-treatment apparatus suitable for use in carrying out the method of the invention.

FIG. 18 shows an embodiment of the heat-treatment apparatus of the invention for treating a plurality of rails at a time. The apparatus has a chain transfer 112 on which a plurality of rail blanks 111*a* are arranged in upright position at a pitch of $l_1$ which is equal to the interval of heat-treatment apparatus. The supply of the rail blanks lll*a* to the chain transfer 112 is conducted by another chain transfer or a suitable conveyor means. The chain transfer 112 conveys the rail blanks 111*a* intermittently such that four railblanks 111*a* are brought into the heat-treatment zone at a time. The rail blanks which have been brought into the heat-treatment zone is designated at numerals 111*b*.

The apparatus further has centering/clamping devices provided with clamping claws 121. The centering/clamping devices 121 are adapted to be projected above the conveyor plane during cooling operation but are retracted below the same before the cooling operation is commenced. Similarly, nozzles 118, 119 for cooling the upper portions of the rail blanks are retracted upwardly by means of a lifting frame 114 operated by lifting gears 115 carried by a column 113 independent from the chain transfer 112.

As the rail blanks 111*a* are brought by the chain transfer 112 to the heat-treatment positions 111*b*, the claws 121 of the centering devices 122, which are arranged at a pitch of 1.5 m to 4 m along each row of the rail blank 111*b* in the heat-treatment position, are closed to clamp respective rail blanks 111*b* such that the neutral axes of respective rail blanks 111*b* are aligned with the axes of the cooling nozzles 118, 120 of respective rows. Then, the claws 121 of the clamping device 123 are lowered so that the legs of each rail blank 111*b* are pulled downwardly by the claws 121, whereby the rail blanks 111*b* are fixed onto the chain transfer 112.

The illustrated embodiment employs a head cooling device which comprises the columns 113, lifting frame 114, head top cooling nozzles 118 secured to the lifting frame 114, lifting frame 116 vertically movably carried by the lifting frame 114, and head side cooling nozzles 119 attached to the lifting frame 116. The head top cooling nozzles 118 are held by the lifting frame 114, while the head side cooling nozzles 119 are held by the lifting frame 116. After the nozzles are set at preselected levels by the lifting device 115, the valves of air supply lines for respective rows are opened to jet the cooling air, thereby rapidly cooling the head portions of respective rail blanks 111*b*, more particularly, the top portions, gauge corners, side surfaces of the heads, jaws and undersides of the jaws of respective rail blanks 111*b*. The control of the colling rate at the rail head portion, necessary for the heat-treatment, is conducted by adjusting the distance between the head top cooling nozzle 118 and the head to surface of each rail blank 111*b*, as well as adjustment of the air flow rate which is conducted by a flow-rate adjusting valve 125. The cooling rate of the side surface regions of the rail head portion is controlled by adjusting the flow rate of cooling air jetted from the head side cooling nozzles 119 by means of an air flow-rate control valve 124. The nozzles have diameters ranging between 2.0 and 9.0 mm. After the setting of the head top cooling nozzles 118 at the preselected height above the head top surface of the rail blanks 111*b*, the head side cooling nozzles 119 are brought to positions where they correctly face the side surfaces of the rail head, by the operation of the lifting frame 116 which in turn is operated by a lifting gear 117. Preferably, the ratio between the total nozzle area of the head top cooling nozzle and that of the head side cooling nozzles ranges between 0.7 and 1.2. The clearance between the head top cooling device and the head side cooling device, i.e., the air exhausting gap, is 15 to 100 mm.

The heat-treatment apparatus further has rail bottom cooling nozzles 120 for respective rows, to which the cooling air is supplied through respective valves. These valves are opened so that cooling air is jetted from the rail bottom cooling nozzles 120, thereby cooling the bottoms of respective rail blanks 111*b* concurrently with the cooling of the rail heads. The rate of cooling of the rail bottoms is controlled so as to match for the cooling rate of the rail heads through adjustment of the cooling air flow rate by the air flow-rate adjusting valves 126, thereby minimizing the bend of the rails after the heat treatment. The ratio of total area of nozzles on said bottom cooling means to the total area of nozzle on the head top cooling means and the head side cooling means is $\frac{1}{2}-1/5$.

During the heat treatment, the temperature of the head of each rail blank 111*b* is measured by a temperature detector (not shown) and, using the thus detected temperature, the cooling time required by each rail is computed by a cooling time control system. The supply of cooling air to each rail blank 111*b* is ceased independently, after elapse of the thus computed cooling time.

When the cooling is finished for all rail blanks 111*b* in the cooling zone, the cooling nozzles 118, 119 are retracted upwardly, while the claws 121 of the clamping devices 123 are opened and then retracted downwardly to a level below the conveyor plane of the chain transfer 112. Then, four heat-treated rail blanks 111*b* are conveyed by the chain transfer 112 out of the cooling zone. The rails which have been brought out of the cooling zone are designated by a numeral 111*c*. These rails 111*c* are then forwarded to a next step by another transfer which is not shown.

Although the embodiment shown in FIG. 18 is designed for treating four rail blanks at a time, the number of the rail blanks treated at one time can be selected freely in accordance with the conditions, e.g., the number of rail blanks obtained from one ingot. The described heat treatment can be conducted equally well regardless of whether only one rail blank is treated or a plurality of rail blanks are treated simultaneously. If the width of the apparatus in the direction orthogonal to the direction of movement of chain transfer is large enough to accommodate two or more short rail blanks, the arrangement may be such that two or more rows of rails, each containing two or more short rail blanks, are heat-treated simultaneously.

Although the embodiment has been described with specific reference to rail blanks in the state immediately after hot rolling, the method and apparatus of this embodiment can apply equally well to rail blanks which have been reheated, although in such a case energy is consumed wastefully for the reheating.

As has been described, this embodiment of the heat-treatment apparatus has a plurality of cooling zones arranged in a side-by-side fashion and each having a length corresponding to the length of the rail blank to be heat-treated. The supply and discharge of the rail-blanks to and from respective cooling zones are conducted by a single chain transfer. The heat-treating conditions of each cooling zone can be adjusted independently of other cooling zones. By virtue of these features, this embodiment offers the following advantages:

(1) The apparatus as a whole can have a compact construction, thus reducing the installation cost and space.

(2) Running cost for the cooling operation is low because of elimination of the invalid cooling zone.

(3) Since the cooling time of each row, i.e., each cooling zone, can be controlled independently of other rows, the heat rreatment can be effected stably despite any longitudinal temperature gradient of the rails after the hot rolling.

(4) Cooling rate can be controlled over a wide range through adjusting one or both of the air flow rate and the distance between the cooling air nozzle and the rail. It is, therefore, possible to produce rails of a variety strength levels from medium to high levels with different sizes and types of steel rail blanks, by means of a single heat-treating apparatus.

(5) The bending of rail during cooling is minimized by virtue of the balance of cooling effected on the bottom side of the rail. This facilitates the transportation to the next step of process and reduces the load in subsequent straightening operation.

EXAMPLE 1

Rail blanks of 132 lbs/yard and 136 lbs/yard having chemical compositions shown in Table 1 were prepared by rolling. These rail blanks in as-rolled state, still remaining at a temperature not less than the austenite field, were subjected to the heat treatment in accordance with the first embodiment of the invention, by means of the heat-treatment apparatus explained before in connection with FIGS. 1 and 2.

TABLE 1

| | (% wt) | | | | | | | |
|---|---|---|---|---|---|---|---|---|
| Rolled Rail | C | Si | Mn | P | S | Cr | Nb | Ceq |
| 132 lbs/yard | 0.79 | 0.23 | 0.88 | 0.024 | 0.009 | — | — | 0.946 |
| 136 lbs/yard | 0.78 | 0.83 | 0.75 | 0.015 | 0.0049 | 0.606 | 0.006 | 1.061 |

Figure 4:
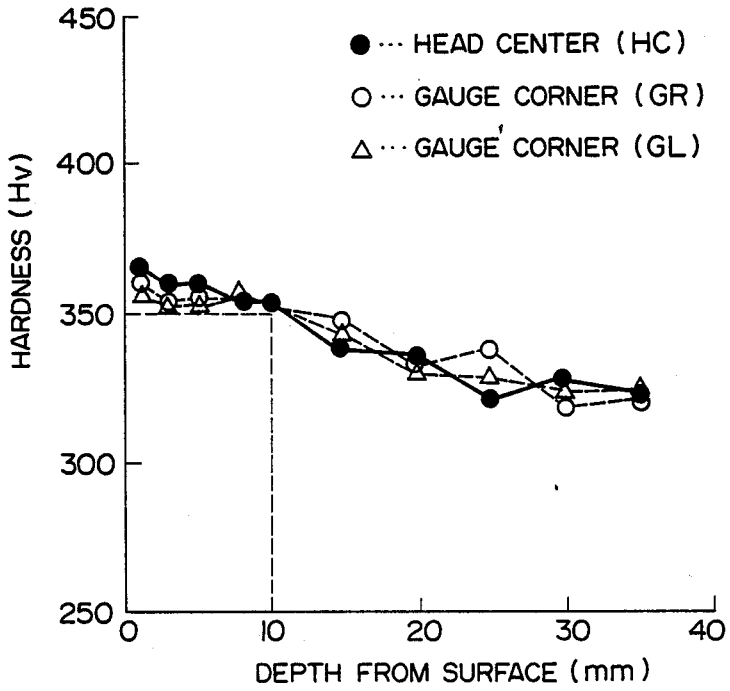
FIGS. 4 and 5 are graphs which show the results of measurement of hardness in the cross-sections of rails heat-treated in accordance with the method of the invention.

The cooling of the 132 lbs/yard rail blank was conducted to obtain hardness of Hv≧350 down to the depth of 10 mm from the rail head top surface, under the condition of Ceq=0.946. The cooling degree F and the nozzle header pressure H were about 26 and 1500 $mmH_2O$ (gauge pressure), respectively, while the flow rate Q was selected to be 41 N $m^3$/m.min. Using these values, the distance H was calculated to be about 60 mm from the formula (1). Using a measured temperature value of $\theta_s=800°$ C., the cooling time was calculated from the formula (2) to be 118.8 seconds or longer. The cooling time, therefore, was selected to be 150 seconds. FIG. 4 shows the hardness distribution in a cross-section of the head of the rail which has been heat-treated as above. From this FIG. 4, it was seen that a fine pearlite structure meeting the condition of Hv>350 was obtained down to the depth of 10 mm under the surface.

Figure 5:
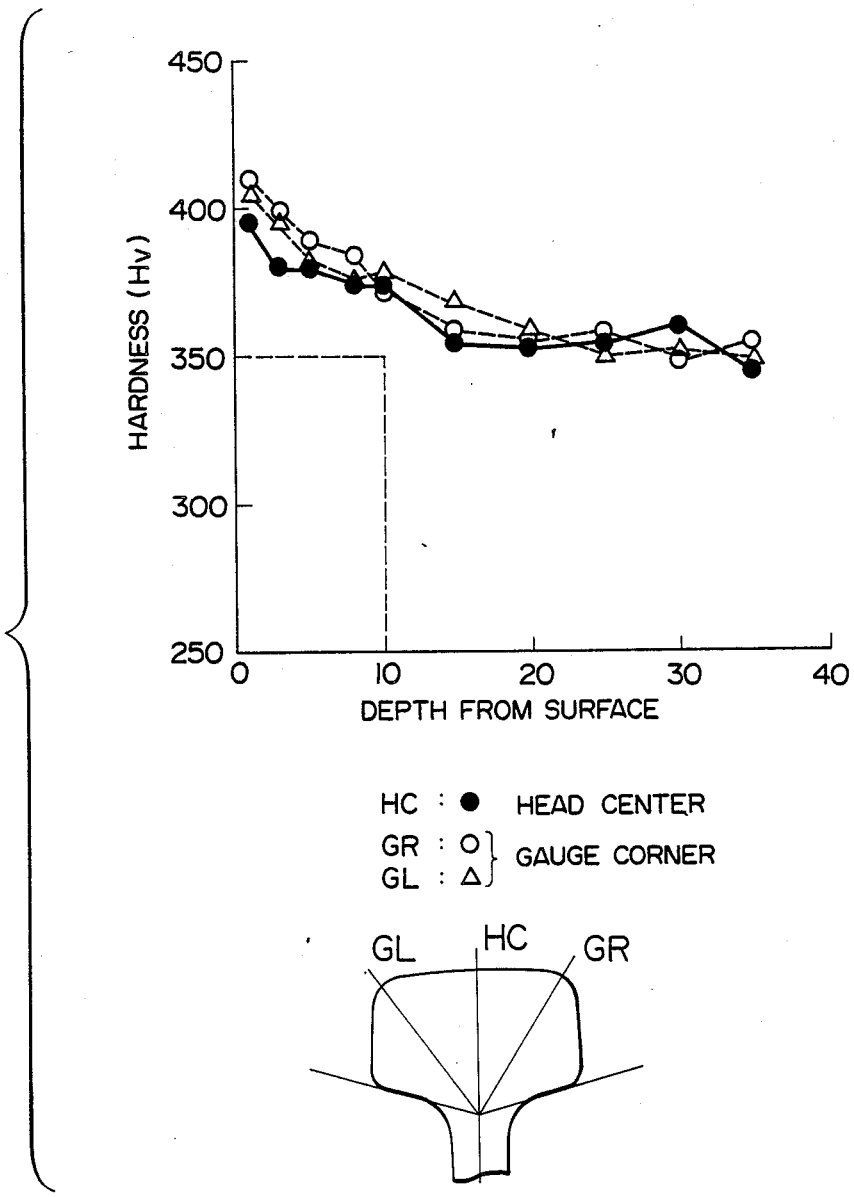
Figure 6A:
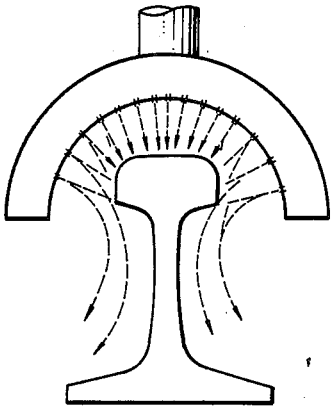
FIGS. 6*a* and 6*b* are illustrations of a nozzle header of a rail-head surrounding type and the pattern of flow of the gaseous cooling medium.
Figure 6B:
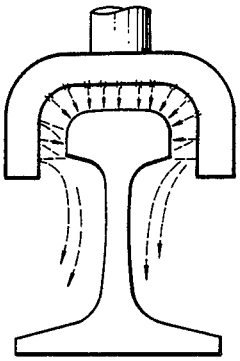
Figure 7A:
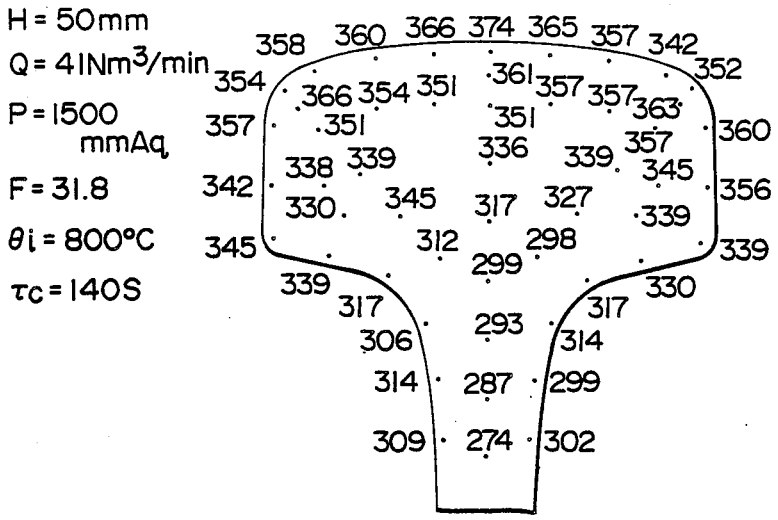
FIGS. 7*a* and 7*b* show the results of measurement of hardness of cross-sections of rails which have been heat-treated by the cooling nozzle of the type shown in FIG. 6*a;*
Figure 7B:
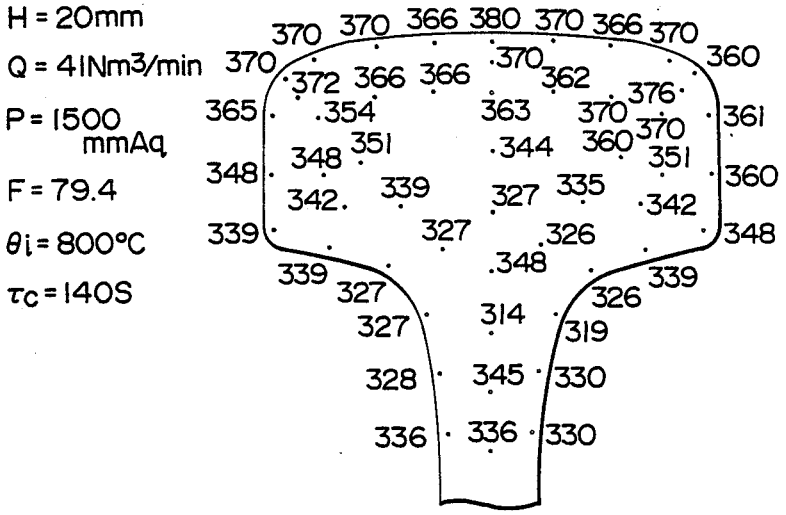
Figure 8:
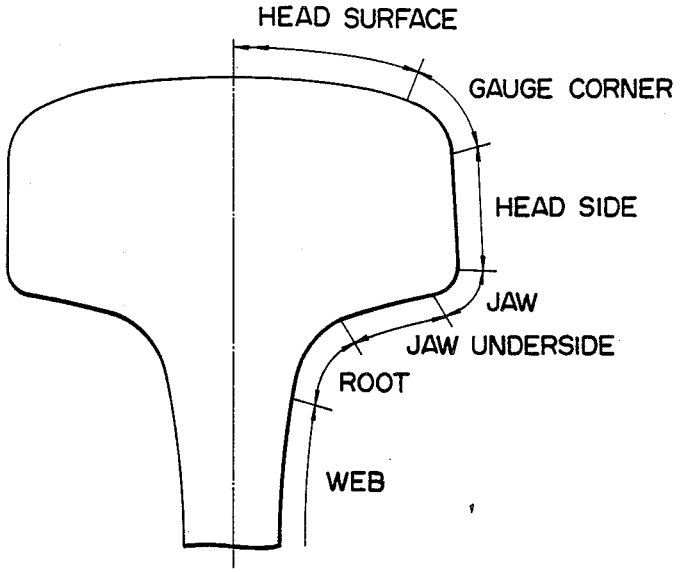
FIG. 8 is an illustration of names of various parts of the surface region of cross-section of a rail head.

The cooling of the 136 lbs/yard rail blank was conducted to obtain hardness of Hv≧370 down to the depth of 10 mm from the rail head top surface, under the condition of Ceq=1.061. The cooling degree F and the nozzle header pressure H were 27 and 1500 $mmH_2O$ (gauge pressure), respectively, while the flow rate Q was selected to be 41 N $m^3$/m.min. Using these values, the distance H was calculated to be about 58 mm from the formula (1). Using a measured temperature value of $\theta_s=780°$ C., the cooling time was calculated from the formula (2) to be 112.1 seconds or longer. The cooling time, therefore, was selected to be 140 seconds. FIG. 5 shows the hardness distribution in a cross-section of the head of the rail which has been heat-treated as above. From this FIG. 5, it was seen that a fine pearlite structure meeting the condition of Hv>375 was obtained down to the depth of 10 mm under the surface, and no harmful structure such as bainite structure was observed.

EXAMPLE 2

A rail was heat-treated in accordance with the second embodiment of the heat-treatment method of the invention shown in FIG. 9 which employs different condition of application of the cooling gas from that in the first embodiment. The rail having the chemical composition shown in Table 2 was prepared by rolling, and the as-rolled rail still remaining at temperature region not less than the austenite field was subjected to the heat treatment.

TABLE 2

| | (wt %) | | | | |
|---|---|---|---|---|---|
| Rolled rail | C | Si | Mn | P | S |
| 132 lbs/yard | 0.79 | 0.23 | 0.88 | 0.024 | 0.009 |

Figure 10A:
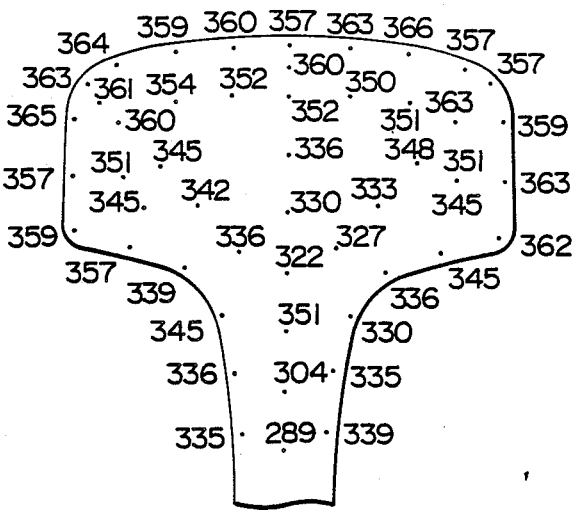
FIGS. 10*a* and 10*b* show the results of measurement of hardness of the cross-sections of rails which have been heat-treated by the second embodiment of the heat-treatment method in accordance with the invention.
Figure 10B:
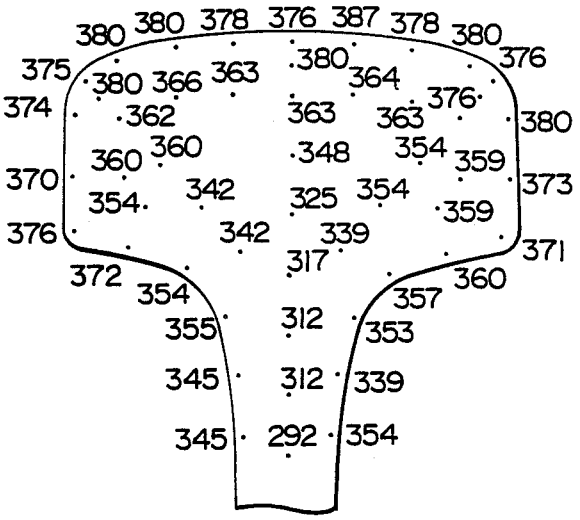
Figure 11A:
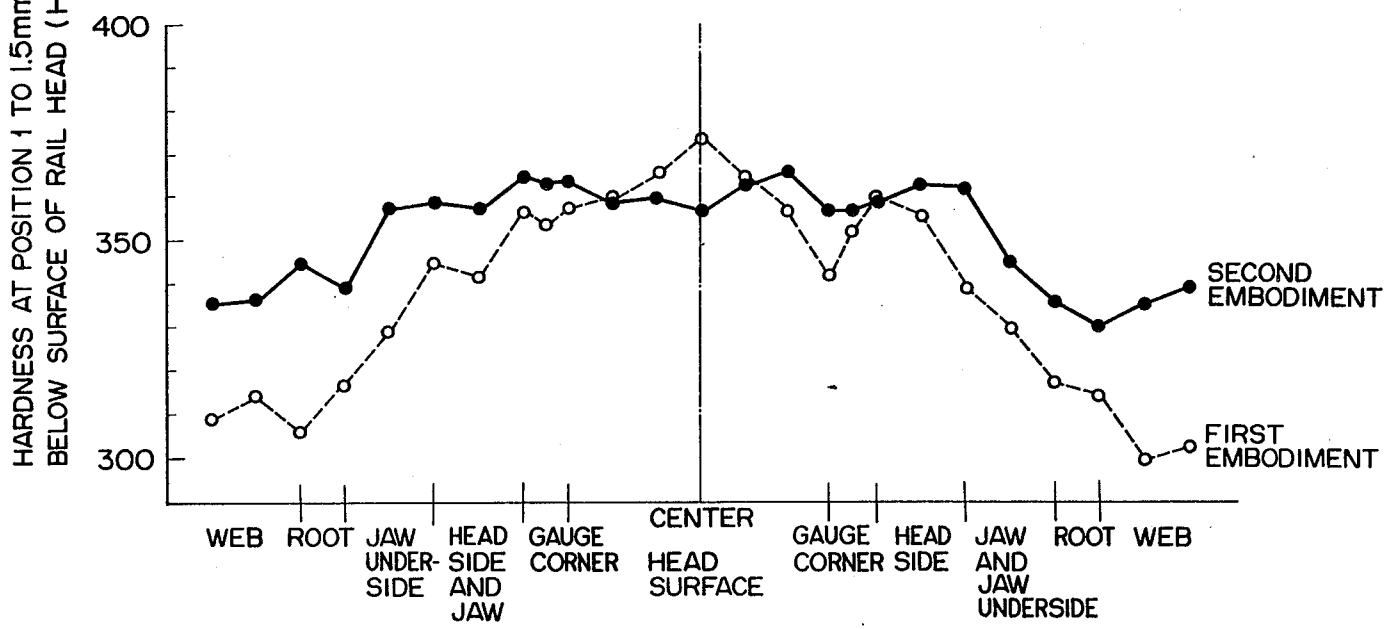
FIGS. 11*a* and 11*b* are chart showing hardness distributions at depths of 1 to 1.5 mm below the rail head surfaces of rails treated by the first and second embodiments of the heat-treatment method of the invention in comparison with each other.
Figure 11B:
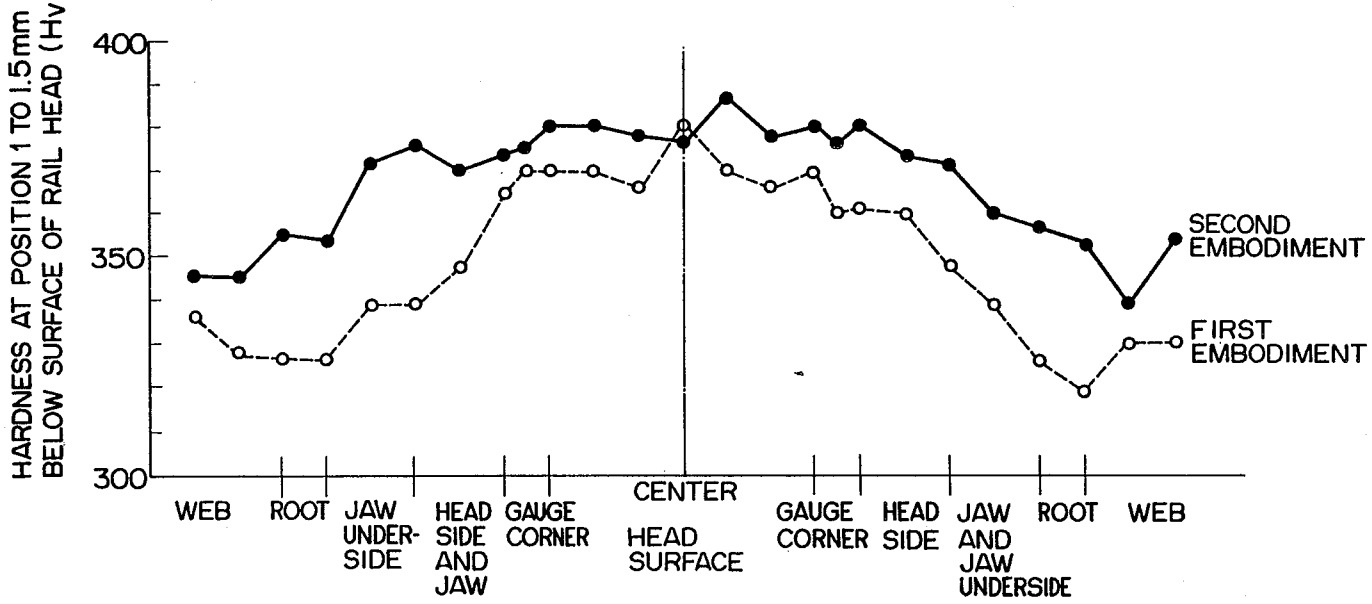

The heat treatment was conducted under two different conditions: namely, conditions for obtaining hardnesses of Hv>350 and Hv>360 down to the depth of 100 mm from the head surface. FIGS. 10*a* and 10*b* show the hardness distributions in cross-sections of the heads of thus heat-treated rails. FIGS. 11*a* and 11*b* show the result of the heat-treatment in accordance with the second embodiment, in comparison with those attained by the first embodiment of the invention.

From these Figures, it was that the rails heat-treated in accordance with the second embodiment provided the aimed hardness levels of Hv≧350 and Hv≧360 from the top to jaws of the rail head, and the hardness in the regions around the underside of the jaws substantially reach the required levels. The whole area of the cross-section of the rail heads showed fine pearlite structures devoid of harmful structure such as bainite structure.

EXAMPLE 3

A practical example of the embodiment for minimizing the bend of the rail during heat treatment for obtaining desired strength will be explained hereinunder.

A 132 lbs/yard roll having a chemical composition shown in Table 3 was prepared by hot rolling, and the as-rolled rail was treated in accordance with the embodiment in which the bend of the rail along the length thereof is minimized by the controlled application of the cooling air to the bottom surface of the rail.

TABLE 3

| Ch No. | C | Si | Mn | P | S |
|---|---|---|---|---|---|
| C42526 | 0.79 | 0.23 | 0.88 | 0.024 | 0.009 |

Figure 15:
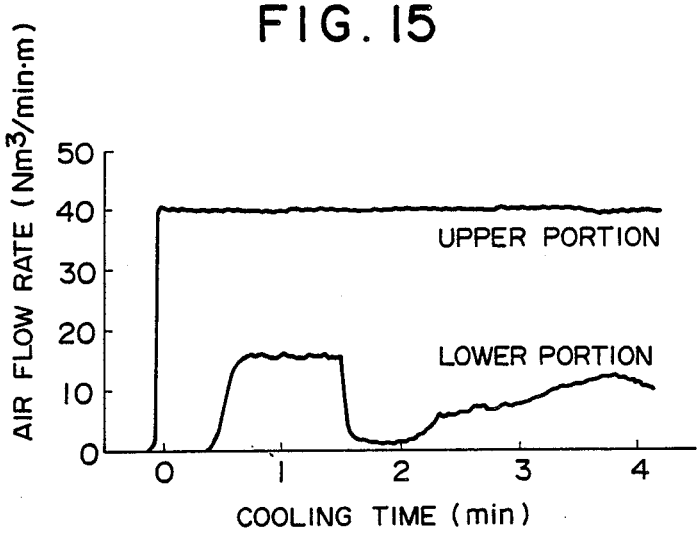
FIG. 15 is a chart showing the changes in air flow rates in the upper and lower regions of a rail during cooling while preventing the bending of rail.

FIG. 15 shows the change in the flow rate of cooling air applied for the purpose of continuous cooling after the whole length of the rail has been brought into the cooling apparatus. The cooling air from the upper nozzles was supplied at a constant rate of 40 $Nm^3$/min.m per unit length (1 m) of the rail, for attaining a strength meeting the condition of Hv $\geqq$350 as measured at a point which is 5 mm below the head top surface, while the flow rate of air from the lower nozzles were changed in accordance with the measured amount of bend.

Figure 16:
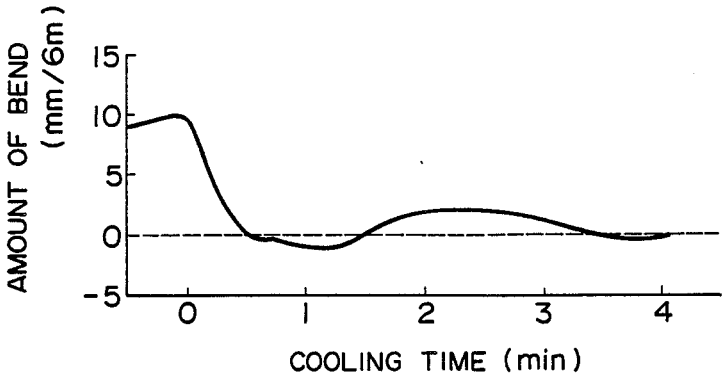
FIG. 16 is a chart showing the change in the bend of a rail which is being cooled in accordance with the embodiment shown in FIG. 13.

FIG. 16 shows the change in the amount of bend per rail length of 6 m during the continuous cooling.

The as-rolled rail still possessing temperature of about 800° C. as measured at the head exhibited a positive bend of about 10 mm immediately after it was brought into the cooling apparatus. The rail then rapidly changed its state into negative bend, as a result of application of the cooling air from the upper nozzles. As this negative bend was detected by the bend measuring device, the supply of air from he lower nozzles was started for cooling the bottom of the rail. This cooling of the rail bottom was conducted with the maximum cooling air flow rate which was about 0.3 to the air flow rate from the upper nozzles, in order to create a tendency of positive bend. The rail began to show a positive bend when the cooling of the rail bottom was continued for a while, e.g., about one minute. In response to this change in the state of the rail, the flow rate of the cooling air from the lower nozzles was decreased and the cooling was completed in four minutes. Meanwhile, the upper nozzle header supplied the cooling air at the constant rate of 40 $Nm^3$/min.m to continuously cool the rail head. In this example, the bend of the rail was maintained within a small value of 3 mm per rail length of 6 m.

Figure 17:
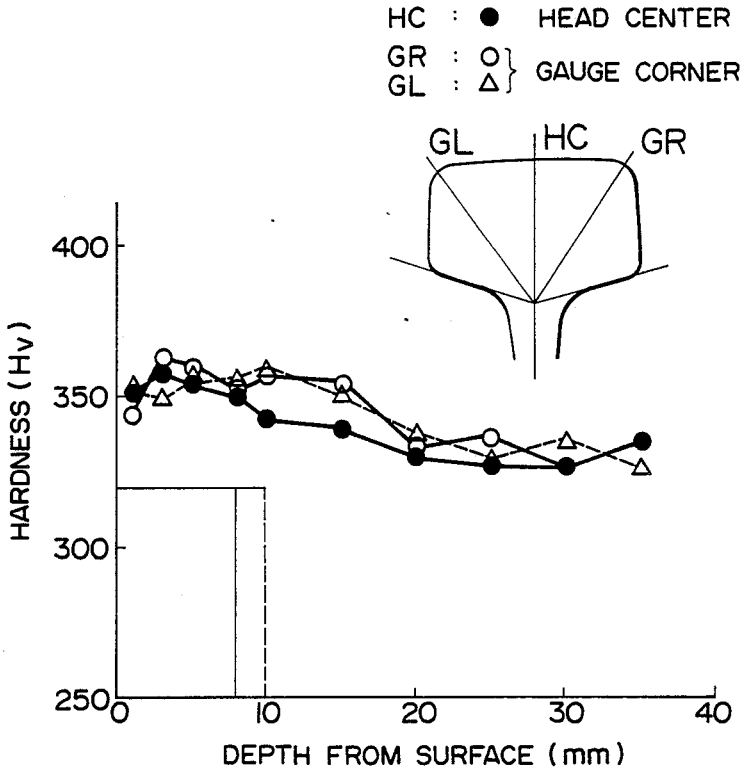
FIG. 17 is an illustration of the result of measurement of hardness in a cross-section of a rail heat-treated in accordance with the embodiment shown in FIG. 13.

FIG. 17 shows the hardness distribution in the cross-section of the head of the rail heat-treated by the method described. It was seen that the a high hardness Hv around 350 is obtained down to the depth of 10 mm or more from the head top surface of the rail. This means that a high strength is attained from the surface region towards the inner side of the rail head. The structure was substantially uniform over the whole area. In particular, fine pearlite structure was obtained in the surface region of the rail head, without suffering from any harmful structure such as bainite or martensite structures.

What is claimed is:

1. A method of heat-treating a rail for producing rails of a variety of strength levels from medium value to high value, said method comprising the steps of:

preparing a steel rail maintained at a high temperature region not lower than the austenite field, and disposing first nozzle means around the head of said rail and second nozzle means around the bottom said rail so that said first and second nozzle means direct air towards said head and bottom of said rail, respectively;

determining the distance H between said first nozzle means and said head of said rail in accordance with the harness level to be attained in said head of said rail and the carbon equivalent of the steel constituting said rail; moving said first nozzle means so that said distance is attained between said first nozzle means and said head of said rail, and directing said air towards said head at a constant flow rate and for a period of time so as to forcedly cool said head of the rail so that the desired strength level in said head of the rail is attained wherein said distance H between said first nozzle means and said head of said rail is determined in accordance with the following formula, from carbon equivalent Ceq of said steel, the hardness Hv to be obtained, flow rate of air Q to be used in the cooling and the pressure P in an upper header constituting said nozzle means;

$Hv=10^n+(200\ ceq-190)$ $n=2.4993+0.039887 \log F-0.0051918 \log F^2$ where,

Hv: Hardness (Vickers hardness at 10 Kg) to be attained in said head of said rail regarding the depth down to 10 mm from the rail head surface, indicative of the strength of said rail Ceq: Carbon equivalent of the steel given by:

$Ceq=C+Mn/6+Si/24+Ni/40+Cr/5-+Mo/4+V/14$

F: cooling degree given by $F=O/\sqrt{P}/H$

Q: flow rate ($m^2$/m.min) of the gaseous cooling medium applied to unite length of rail P: pressure in nozzle header (mmAq, nozzle resistance coefficient f=0.85)

H: distance between nozzle header and the said top surface of said head of said rail (mm)

n: a coefficient determined by the type of nozzle;

measuring an amount of a rail bend occurring along the rail during the cooling of the rail head; and controlling a flow rate of air directed from the second nozzle means toward the bottom of the rail in accordance with the measured amount of the rail bend so that the rail bend in minimized.

2. A method of heat-treating a rail according to claim 1, wherein said nozzle means for cooling said head of said rail is arranged in the form of an arc which is centered at said head of said rail.

3. A method of heat-treating a rail according to claim 1, wherein, during the cooling, said rail is moved continuously, intermittently or reciprocatingly in the cooling apparatus having said nozzle means for cooling said head of said rail.

4. A method of heat-treating a rail according to claim 1, wherein the first nozzle means having both a head top cooling nozzle for cooling the head of the rail and head side-cooling nozzles for cooling the head side, jaw, and jaw underside of the rail, said head side-cooling nozzles being spaced from the head top-cooling nozzles so that the cooling air is exhausted through discharge gaps defined between the head top cooling nozzle and each of the head side-cooling nozzles.

* * * * *